US006766858B2

(12) United States Patent
Nguyen et al.

(10) Patent No.: US 6,766,858 B2
(45) Date of Patent: Jul. 27, 2004

(54) METHOD FOR MANAGING THE PRODUCTION OF A WELL

(75) Inventors: Philip D. Nguyen, Duncan, OK (US); Michael W. Sanders, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/310,403

(22) Filed: Dec. 4, 2002

(65) Prior Publication Data

US 2004/0108112 A1 Jun. 10, 2004

(51) Int. Cl.[7] ..... E21B 43/16; E21B 43/25

(52) U.S. Cl. ..... 166/300; 166/305.1; 166/307; 166/292

(58) Field of Search ..... 166/249, 280.2, 166/271, 285, 292, 300, 305.1, 307

(56) References Cited

U.S. PATENT DOCUMENTS

| | | | | | |
|---|---|---|---|---|---|
| 2,187,895 | A | * | 1/1940 | Stephen | 166/276 |
| 2,288,557 | A | * | 6/1942 | Vollmer | 166/276 |
| 3,044,547 | A | * | 7/1962 | Jarboe, Jr. | 166/276 |
| 3,199,448 | A | * | 8/1965 | Jaffa et al. | 101/123 |
| 3,605,899 | A | * | 9/1971 | Tate et al. | 166/300 |
| 3,826,310 | A | * | 7/1974 | Karnes | 166/276 |
| 4,042,032 | A | * | 8/1977 | Anderson et al. | 166/276 |
| 4,070,865 | A | * | 1/1978 | McLaughlin | 405/264 |
| 4,074,760 | A | * | 2/1978 | Copeland et al. | 166/276 |
| 4,239,084 | A | * | 12/1980 | Sharp et al. | 166/278 |
| 4,335,788 | A | * | 6/1982 | Murphey et al. | 166/278 |
| 4,649,998 | A | * | 3/1987 | Friedman | 166/294 |
| 4,829,100 | A | * | 5/1989 | Murphey et al. | 523/131 |
| 4,871,022 | A | * | 10/1989 | McGlathery | 166/300 |
| 5,058,676 | A | | 10/1991 | Fitzpatrick et al. | 166/278 |
| 5,095,987 | A | | 3/1992 | Weaver et al. | 166/276 |
| 5,311,936 | A | | 5/1994 | McNair et al. | 166/50 |
| 5,339,901 | A | | 8/1994 | McKinzie | 166/289 |
| 5,339,902 | A | * | 8/1994 | Harris et al. | 166/293 |
| 5,377,759 | A | * | 1/1995 | Surles | 166/295 |
| 5,671,809 | A | | 9/1997 | McKinzie | 166/285 |
| 5,697,441 | A | | 12/1997 | Vercaemer et al. | 166/285 |
| 5,704,426 | A | | 1/1998 | Rytlewski et al. | 166/297 |
| 6,070,664 | A | | 6/2000 | Dalrymple et al. | 166/281 |
| 6,070,671 | A | | 6/2000 | Cumming et al. | 166/381 |
| 6,176,315 | B1 | | 1/2001 | Reddy et al. | 166/295 |
| 6,202,751 | B1 | * | 3/2001 | Chatterji et al. | 166/276 |
| 6,237,688 | B1 | * | 5/2001 | Burleson et al. | 166/281 |
| 6,253,850 | B1 | | 7/2001 | Nazzai et al. | 166/277 |
| 6,257,335 | B1 | | 7/2001 | Nguyen et al. | 166/280 |
| 6,311,772 | B1 | | 11/2001 | Myhre et al. | 166/278 |
| 6,318,465 | B1 | | 11/2001 | Coon et al. | 166/278 |
| 6,422,314 | B1 | | 7/2002 | Todd et al. | 166/312 |
| 6,592,660 | B2 | * | 7/2003 | Nguyen et al. | 106/677 |

OTHER PUBLICATIONS

Internet Web page article entitled "Packers >> Zone Flow Tester (ZFT™) Equipment," Baski, Inc., published at www-.baski.com, (3 pp.).

Internet Web page article entitled "Packers: General Information," Baski, Inc., published at www.baski.com, (3 pp.).

* cited by examiner

*Primary Examiner*—David Bagnell
*Assistant Examiner*—Jennifer H Gay
(74) *Attorney, Agent, or Firm*—Robert A. Kent; C. Clark Dougherty, Jr.

(57) ABSTRACT

A method for isolating selected downhole zones of a wellbore comprises utilizing pre-perforated conduit wherein the perforations have been temporarily sealed prior to positioning downhole. A resin-coated particulate, which forms a permeable solid mass to filter and prevent the introduction of formation sand or fines during well production and is used to secure the pre-perforated casing in the wellbore. The pre-perforated casing, permeable solid and formation are perforated and the resulting perforations filled with a curable composition which cures as an impermeable solid. The impermeable areas define individual downhole zones. Devices such as straddle packers or expandable tubes encapsulated in impermeable sleeves are used to isolate the resulting zones.

39 Claims, 4 Drawing Sheets

METHOD FOR MANAGING THE PRODUCTION OF A WELL

BACKGROUND OF THE INVENTION

The current invention relates to a method for managing the production of a well, including testing, treating and controlling the production of fluids from selected intervals of a well.

Modern hydrocarbon production wells can extend several thousand meters. The longest extended reach well drilled to date has a length greater than 11 kilometers. Wells of this nature typically pass through several different types of subterranean formations. In addition to the desired hydrocarbon production zones, production wells frequently encounter brine and fresh water zones as well as in potential shale sloughing areas.

To enhance hydrocarbon production and permit subsequent well maintenance treatments, the non-hydrocarbon producing zones must be isolated from the hydrocarbon producing zones. Additionally, it may be desirable to define select production zones that are isolated from one another. For example, certain hydrocarbon production zones may produce more sand or wax than other areas. As a result, these particular zones may require frequent maintenance not necessary in the other production regions. Therefore, isolation and treatment of only the necessary zones will improve well operation economics by reducing downtime and limiting the quantity of chemicals injected downhole.

SUMMARY OF THE INVENTION

The current invention provides a method for selectively isolating regions or zones of a subterranean formation. In this method, a pre-perforated casing is placed in a wellbore penetrating the subterranean formation. Prior to placement within the wellbore, the perforations within the casing are temporarily closed or sealed by a removable sealant Following placement of the casing, the annulus between the casing and wellbore wall is filled with hardenable resin-coated particulates. After setting of the resin, the resin-coated particles form a fluid permeable mass capable of filtering particles from produced fluids. Subsequently, the casing, set resincoated particles and subterranean formation are perforated by conventional perforation devices at selected locations. The newly created perforations define the regions or zones to be isolated. These perforations are filled with a curable composition, which partially penetrates the formation. Once cured, the composition forms an impermeable mass within the perforations and the areas between each impermeable mass define selected downhole zones. Following establishment of the desired zones, the removable sealant is removed from the perforations within the pre-perforated casing.

In another embodiment, the current invention provides a method for isolating zones of a subterranean formation. Regional or zonal isolation is achieved by placing a pre-perforated casing within a wellbore penetrating the subterranean formation. Prior to placing the pre-perforated casing in the wellbore, the perforations are temporarily closed or sealed with a removable sealant. Following placement of the casing, a hardenable resin-coated particulate is injected downhole and allowed to fill the annulus between the casing and the formation walls. Preferably, the hardenable resin-coated particulate sets or cures as a solid that is permeable to fluids commonly injected downhole or produced from the formation. Once set, the permeable resin is capable of filtering particles from produced fluids. Following setting of the hardenable resin-coated particulate, the casing is perforated by conventional perforation devices at intervals designed to define those zones to be isolated. The resulting perforations are filled with a curable composition, which is allowed to cure to an impermeable mass. Once the curable composition has cured, a device for isolating the region between two impermeable masses is installed in the casing. Suitable devices for isolating the desired region include straddle packers and expandable tubes or expandable well screens, encased within a fluid impermeable rubber, deformable foam or elastomer sleeve. The straddle packer is positioned such that each packer of the straddle packer is adjacent to a perforation filled with cured impermeable composition. As known to those skilled in the art, flow-through tubing joins the separate packers to form the straddle packer. Thus, once installed the straddle packer isolates the zone located between the perforations filled with the cured impermeable composition from fluid communication with the interior of the casing. In the case of an expandable tube or well screen, the device is positioned within the zone defined by two perforations filled with the cured impermeable mass and expanded to contact the interior of the casing. The combination of an impermeable sleeve and expandable tube or well screen is designed to preclude fluid communication between the formation and the interior of the casing. Following expansion, the device isolates the zone located between the perforations filled with the cured impermeable composition from fluid communication with the interior of the casing. To initiate production from the desired portions of the formation, the sealant is removed from the perforations located within the casing. The isolating device connects the producing zones and bypasses the isolated zone.

DETAILED DESCRIPTION OF THE CURRENT INVENTION

The method of the current invention provides the ability to selectively isolate zones or regions of a subterranean formation as a means of precluding the unwanted production of fluids as well as the protection of shale regions and unstable regions. Selective isolation of downhole zones enhances well treatment operations by reducing the quantity of chemicals required for downhole treatments. Additionally, selective isolation of a downhole zone improves the accuracy of downhole testing. Finally, practice of the current invention provides the ability to treat one portion of a subterranean formation while maintaining production of fluids from another portion of the formation.

The practice of the current invention will be described with reference to the drawings. The method of the current invention utilizes a pre-perforated casing 10 or equivalent pipe or conduit. Pre-perforated casing 10 has been modified by sealing or closing off the perforations 14 by means of a removable barrier or sealant 12. Substances suitable for filling or sealing perforations 14 include, but are not limited to waxes, oil soluble resins, oil soluble polymers, ceramics or a mixture of magnesium oxide, magnesium chloride and calcium carbonate. In general, the composition of choice is selected for its ability to preclude fluid flow into pre-perforated casing 10 and for its ability to be readily removed when desired to enable subsequent fluid flow through perforations 14. One preferred sealant is the bridging agent described in U.S. Pat. No. 6,422,314 incorporated herein by reference.

Inorganic compounds insoluble in water but substantially soluble in aqueous ammonium salt solutions are particularly preferred for use as sealant 12. Examples of such compounds include, but are not limited to, metal oxides, metal hydroxides, metal carbonates, metal sulfates, metal tungstates, metal fluorides, metal phosphates, metal peroxides, metal fluosilicates and the like. Examples of suitable metal oxides include, but are not limited to, magnesium oxide, manganese oxide, calcium oxide, lanthanum oxide, cupric oxide and zinc oxide. Of these, magnesium oxide is preferred.

Figure 1:
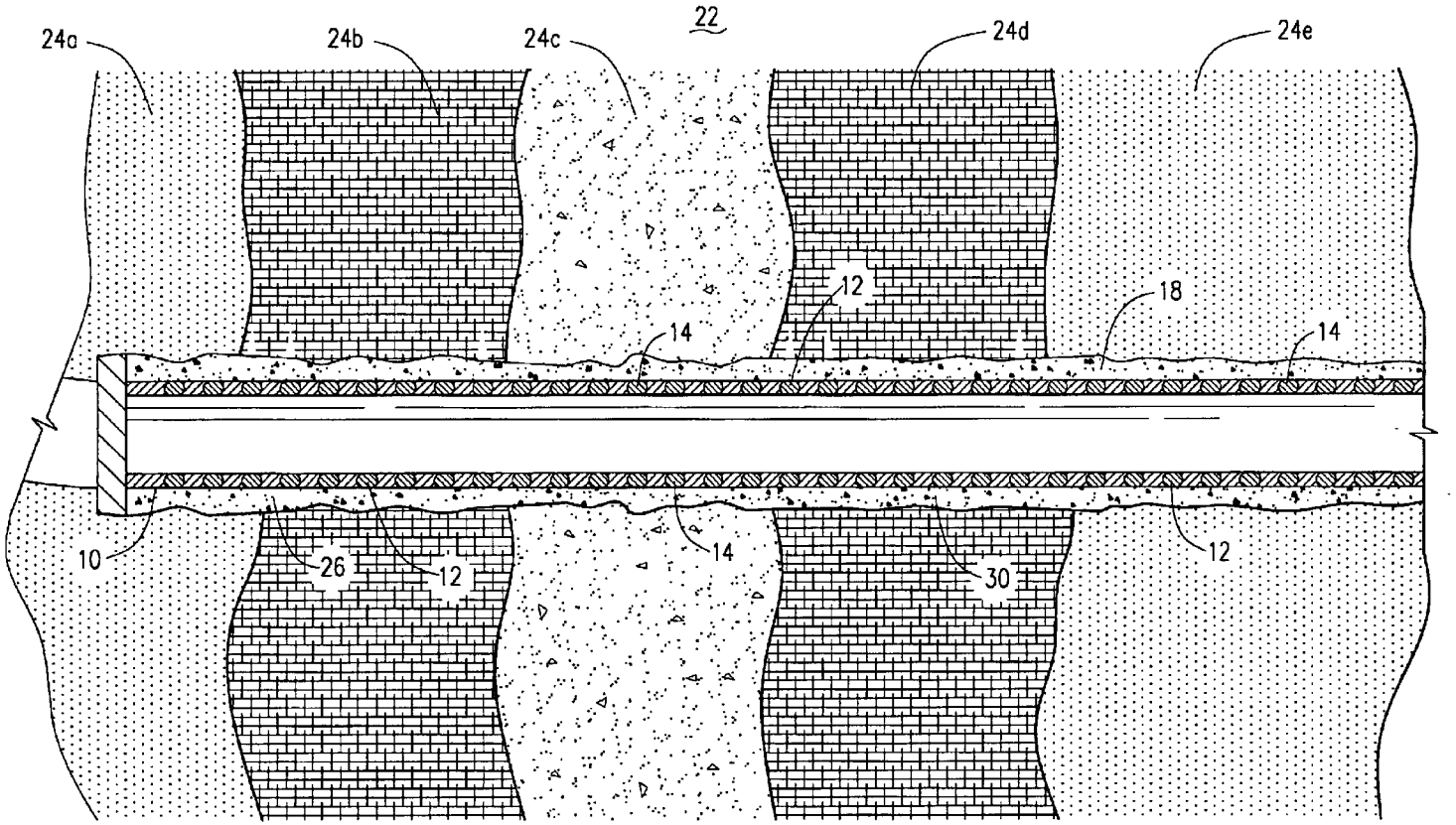
FIG. 1 depicts a pre-perforated casing, with the perforations temporarily sealed, positioned within a wellbore wherein the annulus between the conduit and the wellbore walls is filled with a permeable resin.

As shown in FIG. 1, pre-perforated casing 10 is positioned in a wellbore 18 passing through at least one subterranean formation 22. Following placement of pre-perforated casing 10, a hardenable resin is injected into the annulus 26 formed by placement of pre-perforated casing 10 in wellbore 18. Preferably, the hardenable resin is coated on a proppant or other particulate matter. The resin-coated particulate matter is preferably injected downhole into annulus 26 as a slurry. Following hardening, the consolidated proppant or particulate matter forms a permeable mass 30. Permeable mass 30 provides a means for filtering particulate matter from fluids produced from formation 22.

Resins suitable for use in the present invention may comprise substantially any of the known hardenable resins, such as for example novolak resins, epoxy resins, polyester resins, phenol-aldehyde resins, furan resins, urethanes and the like. Examples of suitable compositions are disclosed in for example U.S. Pat. Nos. 4,829,100, 4,649,998; 4,074,760; 4,070,865 and 4,042,032, the entire disclosures of which are incorporated herein by reference. The particulate matter utilized in the performance of the present invention may comprise sand, bauxite, sintered bauxite, ceramic materials, glass beads, foamed ceramics or glass materials containing voids produced by gases or other processes such as hollow mineral glass spheres sold under the trade name "SPHERELITE" by Halliburton Services, Duncan, Okla., nut shells, coke, plastics, teflon beads or any other material capable of being coated by the resin and subsequently forming a consolidated body having sufficient permeability to facilitate the flow of hydrocarbons therethrough. The resin coated particulate slurry is prepared in accordance with well known conventional batch mixing techniques, such as disclosed in the foregoing U.S. patents or the slurry may be prepared in a substantially continuous manner such as the method disclosed in U.S. Pat. No. 4,829,100, the entire disclosure of which is incorporated herein by reference. Typically, the resin will comprise from about 0.1 to about 5 percent by weight based the weight of the particulate matter.

Figure 2:
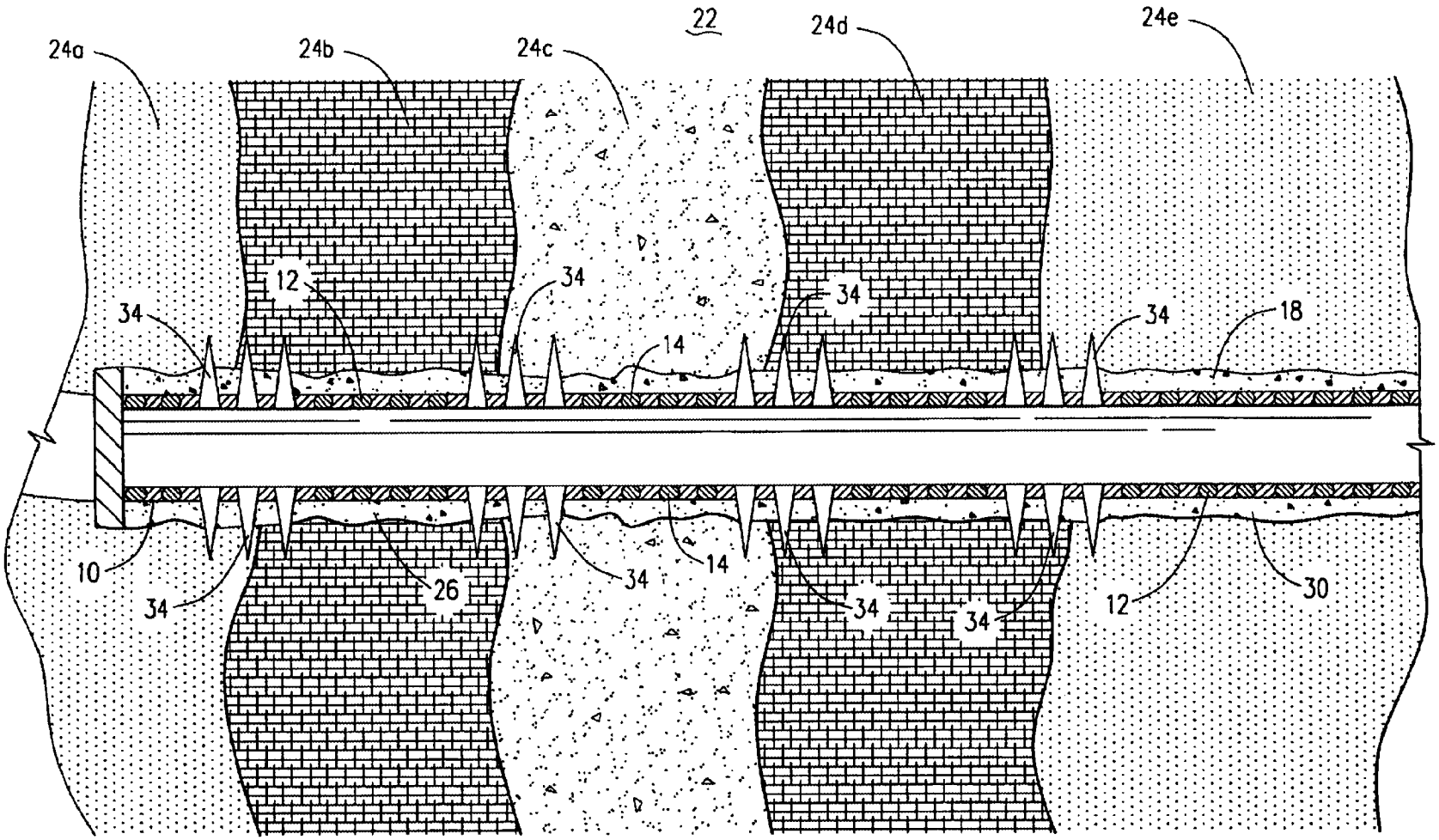
FIG. 2 depicts the wellbore and conduit following perforation of the casing and the wellbore.

Referring now to FIG. 2, following formation of permeable mass 30, pre-perforated casing 10, permeable mass 30 and subterranean formation 22 are perforated by conventional means. The charges used for the perforation process may be reduced compared to normal perforation processes, as the resulting perforations 34 are not intended for production purposes. Therefore, perforations 34 do not require the depth normally associated with production perforation. Perforations 34 are located at selected intervals along the length of wellbore 18. Preferably, perforations 34 define selected regions or zones 24(*a–e*) of subterranean formation 22. Zones 24(*a–e*) may be hydrocarbon producing, water producing, unconsolidated sand, shale or any other common formation or region found in subterranean formations 22.

Figure 3:
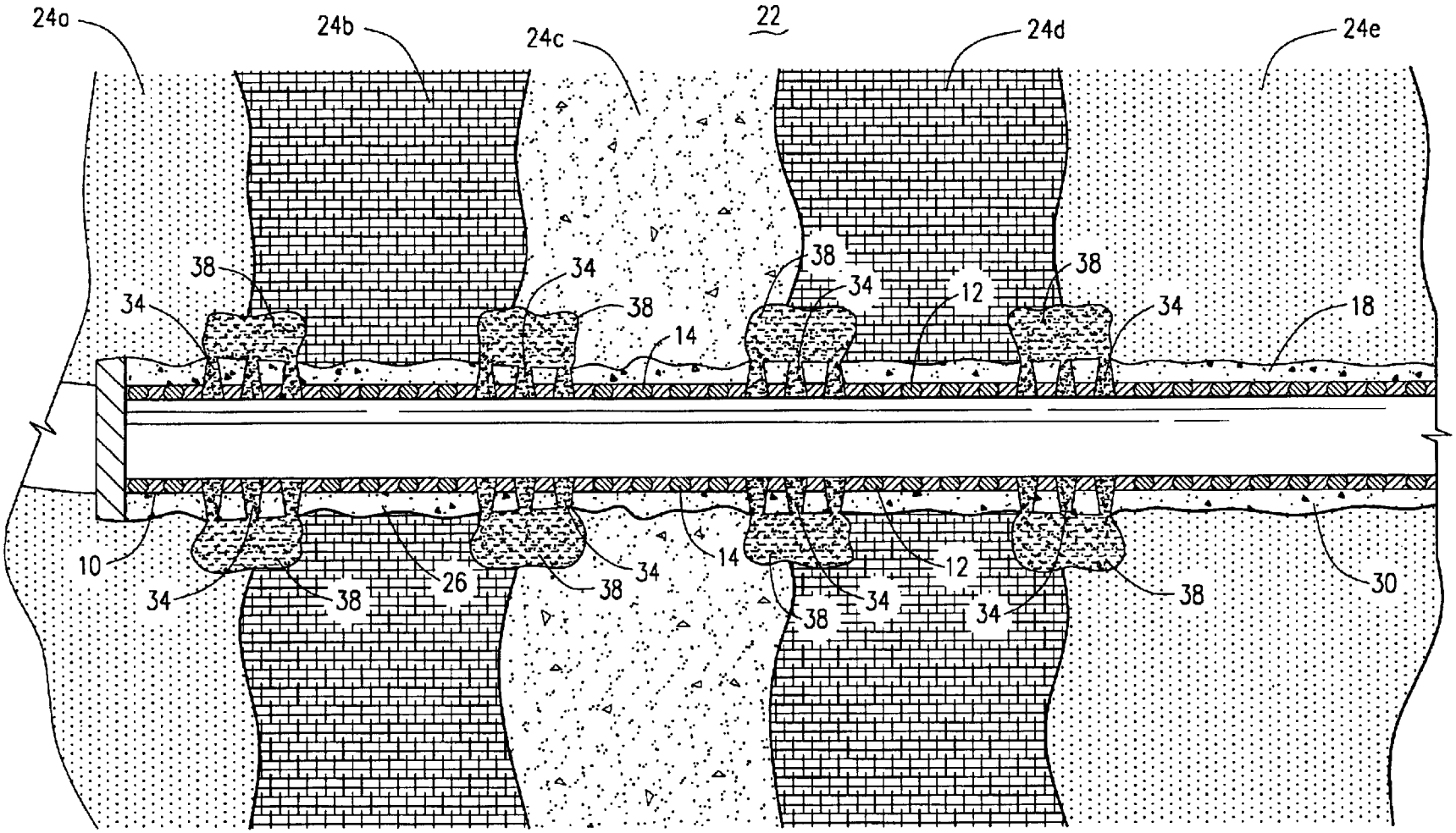
FIG. 3 depicts the perforations filled with an impermeable composition.

Following perforation, a curable composition such as but not limited to an aqueous cement slurry, foamed cement, foamed resins or the resins described above, is injected into perforations 34, filling perforations 34 and partially penetrating formation 22. The composition subsequently sets or cures into an impermeable mass 38. As shown in FIG. 3, impermeable masses 38 define individual formation zones 24 of subterranean formation 22. When using a resin to form the impermeable masses 38, the curable composition may comprise resin and particulate matter. However, in this instance, the resin should comprise greater than 10% by weight based on the weight of the particulates in order to yield an impermeable mass 38.

Preferably, the sealant material is injected into perforations 34 by a pinpoint-injecting device (not shown). Devices suitable for this purpose are well known to those skilled in the art of completing wells and include but are not limited to opposing-cup packers and selective-injection packers. One such device commonly used by Halliburton Energy Services, Inc. includes a retrievable fluid control valve, a retrievable test-treat-squeeze (RTTS) circulating valve, a pinpoint injection packer and a collar locator. The assembled pinpoint-injecting device is a retrievable, treating, straddle packer capable of focusing a treatment or injection fluid at a precise location downhole. Other commonly available devices such as CHAMPE® III and CHAMP® IV Packers can be obtained from Halliburton Energy Services, Inc.

Following formation of impermeable masses 38, temporarily sealed perforations 14 within pre-perforated casing 10 are opened by any means appropriate. For example, when sealant 12 within perforations 14 is a ceramic material vibration or shock waves sufficient to fracture the ceramic will suffice to open perforations 14. If sealant 12 is a wax or other organic compound, then a suitable solvent may be used to open perforations 14. Finally, inorganic oxides, chlorides or carbonate salts may be removed by an acid treatment or even water. One skilled in the art will be readily able to determine the best treatment method for opening perforations 14.

When sealant 12 is a water insoluble inorganic compound, then preferably an ammonium salt solution will be used to remove the inorganic compound. The ammonium salt utilized in the solution can be one or more ammonium salts having the following formula:

$$R_nNH_{4-n}X$$

wherein R is an alkyl group having from 1 to 6 carbon atoms, n is an integer from 0 to 3 and X is an anionic radical selected from halogens, nitrate, citrate, acetate, sulfate, phosphate and hydrogen sulfate.

Examples of suitable ammonium salts include, but are not limited to, ammonium chloride, ammonium bromide, ammonium nitrate, ammonium citrate, ammonium acetate and mixtures thereof. Of these, ammonium chloride is preferred. The ammonium salt utilized is generally included in the clean-up solution in an amount in the range of from about 3% to about 25% by weight of water therein, more preferably in the range of from about 5% to about 14% and most preferably about 5%.

The ammonium salt solution also preferably includes a chelating agent to facilitate the dissolution of the inorganic compound in the solution. The term "chelating agent" is used herein to mean a chemical that will form a water-soluble complex with the cationic portion of the inorganic compound to be dissolved. Various chelating agents can be utilized including, but not limited to, ethylenediaminetetraacetic acid (EDTA) and salts thereof, diaminocyclohexanetetraacetic acid and salts thereof, nitrilotriacetic acid (NTA) and salts thereof, citric acid and salts thereof, diglycolic acid and salts thereof, phosphonic acid and salts thereof, aspartic acid and its polymers and mixtures thereof. Of these, citric acid is preferred. The chelating agent utilized is generally included in the ammonium salt solution in an amount in the range of from about 0.1% to about 40% by weight of the solution, more preferably in the range of from about 5% to about 20% and most preferably about 20%.

Figure 4:
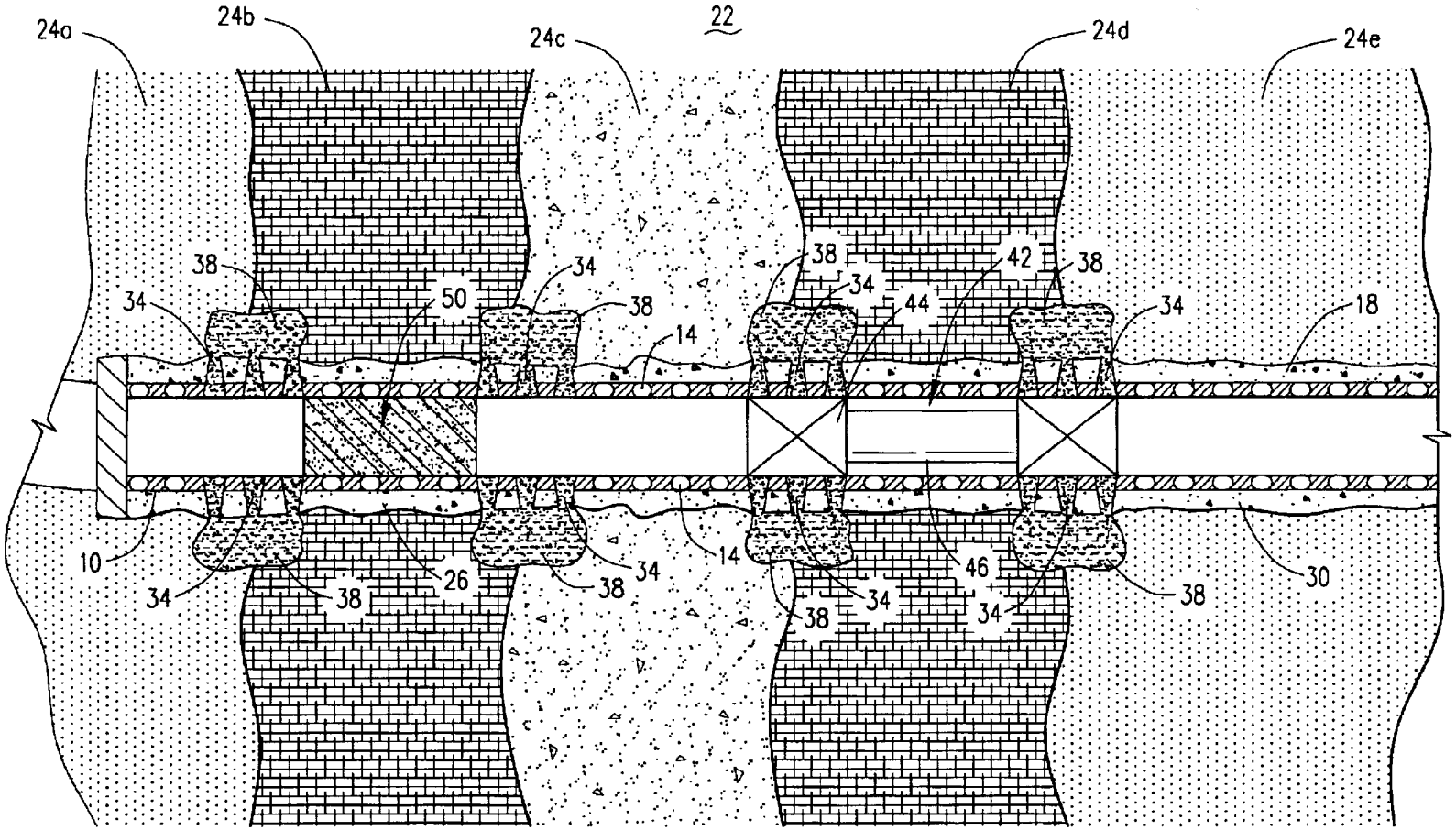
FIG. 4 depicts the pre-perforated conduit following opening of the perforations therein and the use of a straddle packer and a sleeved expandable tube or screen.

After opening perforations 14, production of fluids may be initiated according to methods well known in the art. If necessary, selected zones 24(*a–e*) between impermeable masses 38 may be isolated from production. The preferred means for isolating selected zones 24 include but are not necessarily limited to straddle packers 42 or expandable tubes or expandable well screens 50 encapsulated within an impermeable sleeve. For the purposes of this disclosure, the term expandable tube 50 refers also to expandable well screens and other equivalent devices. The encapsulating sleeve (not shown separately) may be formed from any expandable material such as but not limited to plastic, foam rubber or other elastomeric sleeves. As shown in FIG. 4, straddle packer 42 is any common straddle packer comprising at least one pair of packers 44 joined by at least one flow-through tubing 46. Either arrangement provides adequate means for isolating selected downhole zones. For example, FIG. 4. demonstrates the manner in which impermeable masses 38, expandable tube 50 and straddle packer 42 isolate zones 24(*b*) and 24(*d*) and preclude production of fluids from these areas into wellbore 18.

Thus, the use of straddle packers 42 or expandable tubes 50 encased within impermeable sleeves permits the isolation of downhole zones 24 within subterranean formation 22. Additionally, by isolating selected downhole zones 24, the current invention improves the reliability of downhole testing procedures. Further, the ability to isolate selected zones 24 of subterranean formation 22 will permit treatment of selected zones 24 while continuing production from other zones 24.

The specific steps of the current invention may be adapted for different downhole environments. For example, the steps of opening perforations 14 and placing straddle packers 42 or expandable tube 50 may be reversed. In this manner the current invention isolates selected zones 24 prior to producing any fluids. This embodiment of the current invention may reduce the use of well treatment chemicals by focusing their application only on selected zones 24.

Other embodiments of the present invention will be apparent to those skilled in the art from a consideration of the accompanying drawings, the specification and/or practice of the invention disclosed herein. It is intended that the specification be considered as only exemplary, with the true scope and spirit of the invention being indicated by the following claims.

What is claimed is:

1. A method for isolating a portion of a subterranean formation comprising the steps of:

placing a pre-perforated casing within a wellbore penetrating the subterranean formation, the perforations within the pre-perforated casing being temporarily sealed by means of a sealant;

creating multiple perforations by perforating the casing and formation;

injecting a curable composition into the resulting perforations;

allowing the curable composition to cure as an impermeable mass; and, unsealing the temporarily sealed perforations of the pre-perforated casing.

2. The method of claim 1, wherein the sealant within the perforations of the pre-perforated casing is selected from the group consisting of water insoluble inorganic compounds soluble in aqueous ammonium salt solutions, wax, oil soluble resin, oil soluble polymer, a ceramic, a combination of magnesium oxide, magnesium chloride and calcium carbonate and mixtures thereof.

3. The method of claim 1, further comprising the steps of:

prior to perforating said casing and formation, placing a hardenable resin-coated particulate in the annulus surrounding the perforated casing; and, allowing the resin-coated particulate to set and subsequently creating multiple perforations by perforating the casing, set resin and formation.

4. The method of claim 3, wherein the hardenable resin-coated particulate is permeable to fluid flow when set.

5. The method of claim 4, wherein the hardenable resin portion of the resin-coated particulate is selected from the group consisting of novolak resins, epoxy resins, polyester resins, phenol-aldehyde resins, furan resins, urethanes and mixtures thereof.

6. The method of claim 4, wherein the particulate portion of the resin-coated particulate is selected from the group consisting of sand, bauxite, sintered bauxite, ceramic materials, glass beads, foamed ceramics or glass materials containing voids, nut shells, coke, plastics, and teflon beads.

7. The method of claim 1, wherein the step of unsealing the temporarily sealed perforations in the pre-perforated casing is performed by dissolving the sealant.

8. The method of claim 1, wherein the step of unsealing the temporarily sealed perforations in the pre-perforated casing is performed by heating the sealant.

9. The method of claim 1, wherein the sealant in the perforations of the pre-perforated casing is a water insoluble inorganic compound and wherein the step of unsealing the temporarily sealed perforations in the pre-perforated casing uses an aqueous ammonium salt solution comprising one or more ammonium salts having the formula $R_nNH_{4-n}X$ wherein R is an alkyl group having from 1 to 6 carbon atoms, n is an integer from 0 to 3 and X is an anionic radical selected from halogens, nitrate, citrate, acetate, sulfate, phosphate and hydrogen sulfate.

10. The method of claim 9, wherein the sealant is selected from the group consisting of metal oxides, metal hydroxides, metal carbonates, metal sulfates, metal tungstates, metal fluorides, metal phosphates, metal peroxides, metal flousilicates.

11. The method of claim 9, wherein the sealant is selected from the group consisting of magnesium oxide, manganese oxide, calcium oxide, lanthanum oxide, cupric oxide and zinc oxide.

12. The method of claim 9, wherein the ammonium salt is selected from the group consisting of ammonium chloride, ammonium bromide, ammonium nitrate, ammonium citrate, ammonium acetate and mixtures thereof.

13. The method of claim 1, wherein the step of unsealing the perforations in the pre-perforated casing is achieved by a shock wave.

14. The method of claim 1, further comprising the step of installing at least one straddle packer within the perforated casing.

15. The method of claim 1, further comprising installing and expanding an expandable tube encased within a fluid impermeable sleeve in the area between two impermeable masses.

16. A method for isolating a portion of a wellbore comprising the steps of:

placing a pre-perforated casing within the wellbore, the perforations therein being temporarily sealed by means of a sealant;

placing a hardenable resin-coated particulate in the annulus surrounding the perforated casing;

allowing the resin-coated particulate to set;

creating multiple perforations by perforating the casing, set resin and formation;

establishing individual formation zones by injecting a curable sealant into the resulting perforations;

allowing the sealant to cure as an impermeable mass, the resulting impermeable masses define the individual formation zones;

isolating at least one zone by installing a means for isolating the selected zone; and, unsealing the temporarily sealed perforations of the pre-perforated casing.

17. The method of claim 16, wherein each means for isolating the selected zone is positioned to isolate a zone located between at least two impermeable masses.

18. The method of claim 16, wherein the means for isolating selected zones is selected from the group consisting of expandable tubes encapsulated in an impermeable expandable sleeve or straddle packers.

19. The method of claim 16, wherein the sealant within the perforations of the pre-perforated casing is selected from the group consisting of water insoluble inorganic compounds soluble in aqueous ammonium salt solutions, wax, oil soluble resin, oil soluble polymer, a ceramic, a combination of magnesium oxide, magnesium chloride and calcium carbonate and mixtures thereof.

20. The method of claim 16, wherein the hardenable resin-coated particulate is permeable to fluid flow when set and wherein the hardenable resin-coated particulate when set filters particulates from fluid produced from the formation.

21. The method of claim 20, wherein the hardenable resin portion of the resin-coated particulate is selected from the group consisting of novolak resins, epoxy resins, polyester resins, phenol-aldehyde resins, furan resins, urethanes and mixtures thereof.

22. The method of claim 20, wherein the particulate portion of the resin-coated particulate is selected from the group consisting of sand, bauxite, sintered bauxite, ceramic materials, glass beads, foamed ceramics or glass materials containing voids, nut shells, coke, plastics, and teflon beads.

23. The method of claim 16, wherein the sealant in the perforations of the pre-perforated casing is a water insoluble inorganic compound and wherein the step of unsealing the temporarily sealed perforations in the pre-perforated casing uses an aqueous ammonium salt solution comprising one or more ammonium salts having the formula $R_nNH_{4-n}X$ wherein R is an alkyl group having from 1 to 6 carbon atoms, n is an integer from 0 to 3 and X is an anionic radical selected from halogens, nitrate, citrate, acetate, sulfate, phosphate and hydrogen sulfate.

24. The method of claim 21, wherein the sealant is selected from the group consisting of metal oxides, metal hydroxides, metal carbonates, metal sulfates, metal tungstates, metal fluorides, metal phosphates, metal peroxides, metal flousilicates.

25. The method of claim 21, wherein the sealant is selected from the group consisting of magnesium oxide, manganese oxide, calcium oxide, lanthanum oxide, cupric oxide and zinc oxide.

26. The method of claim 21, wherein the ammonium slat is selected from the group consisting of ammonium chloride, ammonium bromide, ammonium nitrate, ammonium citrate, ammonium acetate and mixtures thereof.

27. The method of claim 21, wherein the step of unsealing the temporarily sealed perforations in the pre-perforated casing is performed by dissolving the sealant.

28. A method for isolating a portion of a wellbore comprising the steps of:

placing a pre-perforated casing within the wellbore, the perforations therein being temporarily sealed by means of a sealant;

placing a hardenable resin-coated particulate in the annulus surrounding the perforated casing;

allowing the resin-coated particulate to set;

creating multiple perforations by perforating the casing, set resin and formation;

establishing individual formation zones by injecting a curable sealant into the resulting perforations;

allowing the sealant to cure as an impermeable mass, the resulting impermeable masses define the individual formation zones;

isolating at least one zone by installing and expanding an expandable tube encapsulated within an impermeable sleeve in the area between two impermeable masses; and, unsealing the perforations of the perforated casing.

29. The method of claim 28, wherein the expandable tube, following expansion, precludes fluid communication between the interior of the pre-perforated casing and the formation.

30. The method of claim 28, wherein the sealant within the perforations of the pre-perforated casing is selected from the group consisting of water insoluble inorganic compounds soluble in aqueous ammonium salt solutions, wax, oil soluble resin, oil soluble polymer, a ceramic, a combination of magnesium oxide, magnesium chloride and calcium carbonate and mixtures thereof.

31. The method of claim 28, wherein the hardenable resin-coated particulate is permeable to fluid flow when set and wherein the hardenable resin-coated particulate when set filters particulates from fluid produced from the formation.

32. The method of claim 28, wherein the sealant in the perforations of the pre-perforated casing is a water insoluble inorganic compound and wherein the step of unsealing the temporarily sealed perforations in the pre-perforated casing uses an aqueous ammonium salt solution comprising one or more ammonium salts having the formula $R_nNH_{4-n}X$ wherein R is an alkyl group having from 1 to 6 carbon atoms, n is an integer from 0 to 3 and X is an anionic radical selected from halogens, nitrate, citrate, acetate, sulfate, phosphate and hydrogen sulfate.

33. The method of claim 28, wherein the step of unsealing the temporarily sealed perforations in the pre-perforated casing is performed by dissolving the sealant.

34. A method for isolating a portion of a wellbore comprising the steps of:

placing a pre-perforated casing within the wellbore, the perforations therein being temporarily sealed by means of a sealant;

placing a hardenable resin-coated particulate in the annulus surrounding the perforated casing;

allowing the resin-coated particulate to set;

creating multiple perforations by perforating the casing, set resin and formation;

establishing individual formation zones by injecting a curable sealant into the resulting perforations;

allowing the sealant to cure as an impermeable mass, the resulting impermeable masses define the individual formation zones;

isolating at least one zone by installing straddle packers joined by a flow-through tubing in the area between two impermeable masses; and, unsealing the perforations of the perforated casing.

35. The method of claim 34, wherein the straddle packer precludes fluid communication between the interior of the pre-perforated casing located between two perforations and the formation.

36. The method of claim 34, wherein the perforations of the pre-perforated casing are sealed with a sealant selected from the group consisting of water insoluble inorganic compounds soluble in aqueous ammonium salt solutions, wax, oil soluble resin, oil soluble polymer, a ceramic, a combination of magnesium oxide, magnesium chloride and calcium carbonate and mixtures thereof.

37. The method of claim 34, wherein the hardenable resin-coated particulate is permeable to fluid flow when set and wherein the hardenable resin-coated particulate when set filters particulates from fluid produced from the formation.

38. The method of claim 34, wherein the sealant in the perforations of the pre-perforated casing is a water insoluble inorganic compound and wherein the step of unsealing the temporarily sealed perforations in the pre-perforated casing uses an aqueous ammonium salt solution comprising one or more ammonium salts having the formula $R_nNH_{4-n}X$ wherein R is an alkyl group having from 1 to 6 carbon atoms, n is an integer from 0 to 3 and X is an anionic radical selected from halogens, nitrate, citrate, acetate, sulfate, phosphate and hydrogen sulfate.

39. The method of claim 34, wherein the step of unsealing the temporarily sealed perforations in the pre-perforated casing is performed by dissolving the sealant.

* * * * *